United States Patent [19]

Craighead

[11] 4,068,787

[45] Jan. 17, 1978

[54] MONEY BUCKLE

[76] Inventor: James W. Craighead, 501 Dexter St., Denver, Colo. 80220

[21] Appl. No.: 704,511

[22] Filed: July 12, 1976

[51] Int. Cl.[2] ..... A45C 1/04

[52] U.S. Cl. ..... 224/26 E; 24/163 K; 224/5 R

[58] Field of Search ..... 224/5 R, 26 R, 26 C, 224/26 D, 26 E, 26 T, 5 L, 28 R, 28 B; 24/3 F, 73 BH, 163 K, 3 R; 2/311, 321, 325; 40/21 C

[56] References Cited

U.S. PATENT DOCUMENTS

| | | | |
|---|---|---|---|
| 1,012,112 | 12/1911 | Swindell | 224/5 R X |
| 1,339,309 | 5/1920 | Waltz | 24/73 BH X |
| 1,606,849 | 11/1926 | Spear | 224/26 E |
| 1,753,765 | 4/1930 | Withers | 224/26 E |
| 2,156,373 | 5/1939 | Craighead | 224/26 C |
| 3,088,234 | 7/1963 | Lesser et al. | 24/163 K X |
| 3,908,239 | 9/1975 | Gorman | 24/163 K |
| 3,927,442 | 12/1975 | Foster | 24/163 K |

FOREIGN PATENT DOCUMENTS

| | | | |
|---|---|---|---|
| 1,167,815 | 11/1956 | France | 2/321 |

*Primary Examiner*—Lawrence J. Oresky
*Assistant Examiner*—Winston H. Douglas
*Attorney, Agent, or Firm*—Sheridan, Ross, Fields & McIntosh

[57] ABSTRACT

A money buckle is provided for securely and secretly retaining paper valuables, such as money. The buckle has an envelope-like configuration with a cavity for receiving the valuables and a safety flap foldable over the open end of the buckle and having an aperture engageable with an inwardly projecting hook which also engages a hole in a belt to which it is attached to secure the belt around the waist of the wearer. Thus, the safety flap is securely held in place between the back of the buckle and the belt when being worn. Also, the money buckle is accessible without removing the belt by merely releasing the hook from the hole in the belt and opening the flap.

5 Claims, 6 Drawing Figures

MONEY BUCKLE

BACKGROUND OF THE INVENTION

1. Field of the Invention

The present invention relates to articles of apparel for secreting valuables, and more particularly, to a money buckle for attachment to a belt in which paper valuables can be secured.

2. Description of the Prior Art

Various attempts have been made to make belts and buckles which can be ued for secreting valuables. The difficulty with the prior art devices of this type is that many of them are bulky and unsightly, or that it is difficult, if not impossible, to remove the valuables from the device or replace them therein without removal of the belt or the buckle. Examples of buckles for retaining valuables are found in U.S. Pat. No. 1,723,742 to Marcus; U.S. Pat. No. 1,878,792 to Marinsky; U.S. Pat. No. 2,836,351 to Epstein; and U.S. Pat. No. 931,823 to Waugh. Each of these devices has the disadvantage that they comprise a buckle which is relatively thick and unsightly and in some cases, it is rather obvious that it is made for the storage of valuables and therefore, the security to be afforded thereby is lost.

Still other examples of prior art buckles are U.S. Pat. No. 1,629,404 to Mitchell; U.S. Pat. No. 603,974 to Scheuber; U.S. Pat. No. 3,542,263 to Callahan; and U.S. Pat. No. 1,753,765 to Withers. None of the buckles shown in these references is entirely satisfactory either from the standpoint of convenience or from the standpoint of security.

SUMMARY OF THE INVENTION

In accordance with this invention, a money buckle is provided for secretly carrying valuables and the like for use with a belt having a first end which folds back upon itself for attachment to a buckle and having a plurality of spaced holes extending longitudinally from a point adjacent a second end for adjustably fastening the belt about the waist of the wearer. The buckle comprises an envelope-like body which has an inner and outer wall interconnected along one end and along opposite side edges to form a cavity for receiving the valuables and has a foldable safety flap for closing the opposite end to conceal the valuables. Means is provided adjacent one end for releasably attaching the buckle to the first end of a belt and a means extends from the buckle body adjacent the opposite end to releasably engage the flap and one of the holes in the belt for holding the flap in closed position between the body and the belt and for holding the belt fastened.

More particularly, the buckle further includes a lateral slot in the inner wall adjacent the one end and has a recess adjacent the other end which is covered by the flap when the flap is in closed position. Furthermore, a generally planar member is provided in the cavity and has a loop attached thereto thereto which extends through the slot for attachment to the first end of the belt. A hook is also attached to the planar member at a point spaced from the loop and extends through the recess and is engagable with the aperture to hold the flap in closed position. Also, a valuable holder can be provided in the cavity between the outer wall and the member, the holder having an end extending beyond the end of the member for grasping the holder to pull it out of the cavity.

DESCRIPTION OF PREFERRED EMBODIMENT

Figure 1:
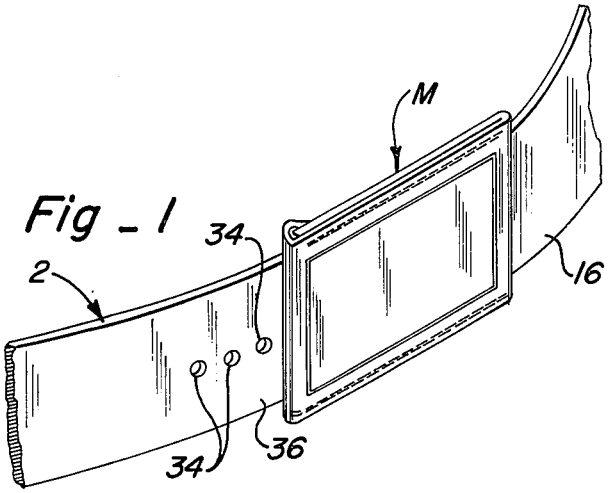
FIG. 1 is a perspective view of a money buckle constructed in accordance with this invention and attached to a belt.
Figure 2:
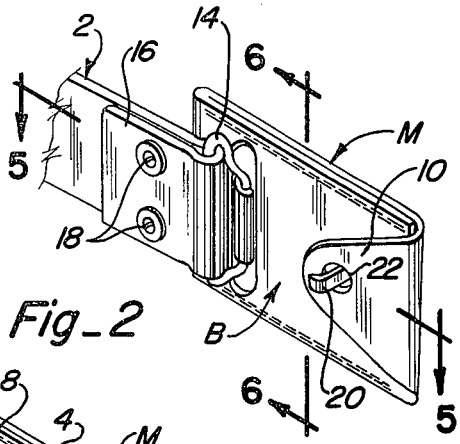
FIG. 2 is a rear perspective view of the buckle of FIG. 1 showing further details thereof.
Figure 3:
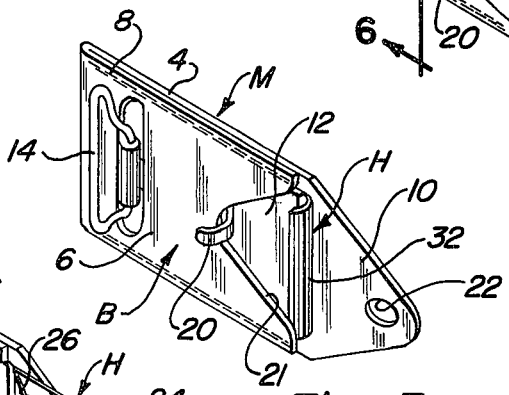
FIG. 3 is a perspective view, similar to FIG. 2 but showing the safety flap in open position.

In accordance with this invention, a money buckle M is provided which is connectable to and usable with a belt 2. The money buckle M includes a body B formed of a single piece of material, such as leather, having an outer wall 4 and an inner wall 6 which are folded over upon one another to form one end and the longitudinal side edges are innerconnected, as by stitching 8. The outer wall 4 also has an intrically formed safety flap 10 which can be in the open position of FIG. 3 for removing of valuables and in the closed position of FIG. 2 for retaining the valuables in secure condition. Within the envelope formed by body B is a cavity in which a generally planar member 12 is received. Member 12 has a loop 14 formed adjacent one end to receive the first end 16 of the belt 2 which is folded back upon itself and is releasably connected by means of snaps 18. Thus, the buckle can be completely removed from the belt by releasing snaps 18 and sliding end 16 through loop 14. Member 12 also includes a hook 20 adjacent to, but spaced from its opposite end, which hook projects through a generally V-shaped recess 21 formed in inner wall 6 and is releasably engageable with an aperture 22 in safety flap 10.

Figure 4:
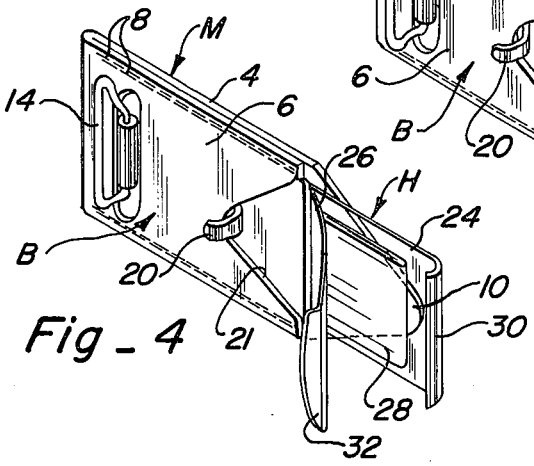
FIG. 4 is a perspective view, similar to FIGS. 2 and 3, but showing the valuable holder partially removed from the safety buckle.
Figure 5:
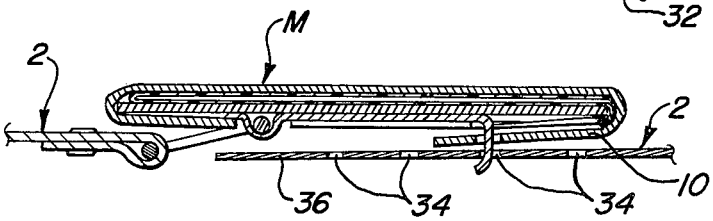
FIG. 5 is a horizontal section, taken along line 5—5 of FIG. 2, showing the manner in which the buckle engages holes in the end of a belt.
Figure 6:
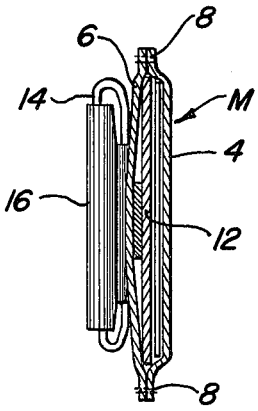
FIG. 6 is a vertical section, taken along line 6—6 of FIG. 2, showing further details of the interior construction of the money buckle.

Conveniently, valuables can be placed in the cavity of the body between member 12 and outer wall 4. To make the insertion and removal of valuables, such as money, checks and the like easier, a valuable holder H conveniently can be provided which may be made of transparent plastic material as shown and includes a first side 24 and a second side 26 which may be formed integrally and folded back upon each other to receive the valuable papers 28 as best seen in FIGS. 4 and 5. The holder H may be slipped between member 12 and outer wall 4 of body B to the position shown in FIG. 3. The sides of the holder conveniently have outwardly extending curved ends 30 and 32 which the user can grasp to pull the holder from the buckle.

Once the valuables are in place, the safety flap 10 can be folded over the ends 30 and 32 of holder H and the aperture 22 can be slipped over hook 20. Thereafter, the hook can be inserted in one of the holes 34 in the second end 36 of the belt 2, as best seen in FIG. 5, wherein the safety flap 10 is now securely held in place between inner wall 6 of the buckle and the end 36 of the belt. Also, when it is desirable to retrieve the valuables, the belt need not be completely removed but can be unhooked from a hole 34 whereupon safety flap 10 can be pulled open by disengaging aperture 22 from hook 20 to the open position of FIG. 3.

Although it is contemplated that the buckle will be made of leather, it will be understood that plastic could be used which could be heat sealed along the edges, or that even for some purposes a heavy fabric might be usable.

From the foregoing, the advantages of this invention are readily apparent. A convenient money buckle has been provided of simple construction which can be easily attached or removed from a belt and which will receive and retain valuables in a secret but easily accessible cavity within the buckle. Also, when the valuables are in the buckle, a safety flap can be closed thereover and held in position by a hook and also by its position between the back of the buckle and the end of the belt. The valuables can be removed by merely unhooking the end of the buckle from the end of the belt and opening the safety flap without the necessity of removing the belt from the wearer.

The invention has been described in detail with particular reference to a preferred embodiment thereof, but it will be understood that variations and modifications can be effected within the spirit and scope of the invention.

What is claimed is:

1. A money buckle for secretly carrying valuables and the like, for use with a belt having a first end which folds back upon itself for attachment to a buckle and having a plurality of spaced holes extending longitudinally from a point adjacent a second end for adjustably fastening the belt about the waist of the wearer, said buckle comprising:

an envelope-like body which has an inner and an outer wall interconnected along one end and along opposite edges to form a cavity for receiving the valuables and has a foldable safety flap for closing the opposite end to conceal the valuables;

first means adjacent said one end for releasably attaching said buckle to the first end of the belt;

second means extending from said body adjacent said opposite end releasably engagable with and extendable through said flap and further engagable with one of the of the holes in the belt for holding said flap in a closed position sandwiched between said body and said belt when said second means is in engagement with one of the holes in the belt.

2. A money buckle, as claimed in claim 1, wherein:

said flap has an aperture therein; and said second means is a hook which is engagable with said aperture to hold said flap in closed position and extendable through and engagable with one of the holes in the belt.

3. A money buckle, as claimed in claim 1, wherein:

said first means includes a loop around which the end of the belt is attachable.

4. A money buckle for secretly carrying valuables and the like, for use with a belt having a first end which folds back upon itself for attachment to a buckle and having a plurality of spaced holes extending longitudinally from a point adjacent a second end for adjustably fastening the belt about the waist of the wearer, said buckle comprising:

an envelope-like body which has an inner and outer wall interconnected along one end and along opposite side edges to form a cavity for receiving the valuables and having a safety flap formed integrally with said outer wall, said flap, having an aperture therein and being foldable over said inner wall for closing the opposite end, said inner wall having a lateral slit adjacent said one end and having a recess adjacent said other end which is covered by said flap when said flap is in closed position;

a generally planar member in said cavity;

a loop attached adjacent one end of said member and extending through said slit for attachment to the first end of the belt;

a hook attached to said member intermediate the ends thereof and extending through said recess and engagable with said aperture to hold said flap in closed position and extendable through and engagable with one of the holes in the belt, said valuables being insertable in the cavity between said outer wall and said member and held securely in place with said flap sandwiched between said inner wall and the belt.

5. A money buckle, as claimed in claim 4, further including:

a valuable holder in said cavity between said outer wall and said member, said holder having an end extending beyond the end of said member for grasping said holder to pull it out of said cavity.

* * * * *